US006709126B1

(12) United States Patent
Leen

(10) Patent No.: US 6,709,126 B1
(45) Date of Patent: Mar. 23, 2004

(54) LED NIGHTLIGHT

(76) Inventor: Monte A. Leen, 1804 W. Lake Sammamish Pkwy. NW., Bellevue, WA (US) 98008

( * ) Notice: Subject to any disclaimer, the term of this patent is extended or adjusted under 35 U.S.C. 154(b) by 0 days.

(21) Appl. No.: 10/302,460

(22) Filed: Nov. 22, 2002

(51) Int. Cl.[7] ..... H05B 37/00
(52) U.S. Cl. ..... 362/95; 362/802; 315/159
(58) Field of Search ..... 362/800, 802, 362/29, 226, 95; 315/159, 158

(56) References Cited

U.S. PATENT DOCUMENTS

| | | | | |
|---|---|---|---|---|
| 3,061,716 | A | 10/1962 | Benander | 240/73 |
| 3,795,830 | A | 3/1974 | Richardson | 307/311 |
| 4,727,289 | A | 2/1988 | Uchida | 315/71 |
| 4,814,667 | A | 3/1989 | Tanaka | 313/500 |
| 5,481,442 | A | 1/1996 | Dickie et al. | 362/95 |
| 5,544,025 | A | 8/1996 | Bohlool et al. | 362/95 |
| 5,613,873 | A | 3/1997 | Bell, Jr. | 439/490 |
| 5,655,830 | A | 8/1997 | Ruskouski | 362/240 |
| 5,726,535 | A | 3/1998 | Yan | 315/185 |
| 5,850,126 | A | 12/1998 | Kanbar | 315/200 |
| 5,964,516 | A | 10/1999 | Lai | 362/95 |
| 6,227,679 | B1 | 5/2001 | Zhang et al. | 362/236 |
| 6,366,214 | B1 | 4/2002 | Mitchell et al. | 340/815.45 |
| 6,400,104 | B1 | 6/2002 | Ham | 315/312 |
| 6,431,719 | B1 | 8/2002 | Lau et al. | 362/92 |
| 6,550,953 | B1 * | 4/2003 | Ichikawa et al. | 315/56 |

* cited by examiner

*Primary Examiner*—David Vu
(74) *Attorney, Agent, or Firm*—Dean A. Craine

(57) ABSTRACT

A nightlight having a base unit with a central cavity designed to house a light sensor and a printed circuit board. Mounted on the front surface of the base unit is a transversely aligned LED tube. The LED tube is disposed between two struts that extend forward from the front surface of the base unit. Attached to the front surface of the base unit and over the LED tube is a fixed half-spherical lens. Disposed over the lens is a rotating, half-spherical outer cap having an approximately quarter-spherical sized opening that allows a portion of the lens to be exposed so that light from the LED tube may be emitted therethrough. Thus, when the outer cap is selectively rotated around the base unit, the quarter-spherical sized opening is rotated therewith, and a dissipated broad beam of light may be selectively aimed in any direction.

11 Claims, 4 Drawing Sheets

LED NIGHTLIGHT

BACKGROUND OF THE INVENTION

1. Field of the Invention

This invention pertains to the field of nightlights and, in particular, to nightlights that use a LED light source.

2. Description of the Related Art

There are generally two types of nightlights—nightlights that emit a scattered, diffused pattern of light and nightlights that emit a narrow beam of light. Nightlights that emit a scattered, diffused pattern of light are designed to illuminate large areas such as restrooms or hallways. Nightlights that emit a relatively narrow beam of light are used to illuminate a relatively small surface directly in front of the lens such as a wall or step.

One drawback of many nightlights is that they extend relatively far from the electrical receptacle thereby making them distracting and easy to impact or kick from the receptacle.

Another drawback is that many nightlights use incandescent or fluorescent bulbs with relatively short life spans. Some manufacturers take advantage of the relatively short life span of the bulb by marketing the nightlights with non-replaceable bulbs so that the entire nightlight must be discarded when the bulb burns out.

What is needed is a low profile, long lasting nightlight that emits a soft, broad beam of light.

SUMMARY OF THE INVENTION

Disclosed herein is a LED nightlight comprising a main base unit with two standard, electrical prongs designed to connect to a standard two- or three-prong AC electrical receptacle. Disposed inside the base unit is a transversely aligned LED tube that contains two longitudinally aligned bulbs that extend inward from the opposite ends of the tube. Disposed over the LED tube and the front surface of the base unit is a half-spherical, transparent or semi-transparent lens. Disposed over the lens is a half-spherical outer cap with a quarter-spherical opening formed thereon. The outer cap includes a quarter-spherical opening that exposes approximately one-half of the lens so that light from the LED tube may be emitted therethrough. When the outer cap is selectively rotated around the base unit, the user changes the location of the quarter-spherical sized opening relative to the lens so that light is emitted in different directions.

The nightlight includes a photo sensor that activates the LED tube bulb when there is insufficient ambient light in the room.

DESCRIPTION OF THE PREFERRED EMBODIMENT(S)

Figure 1:
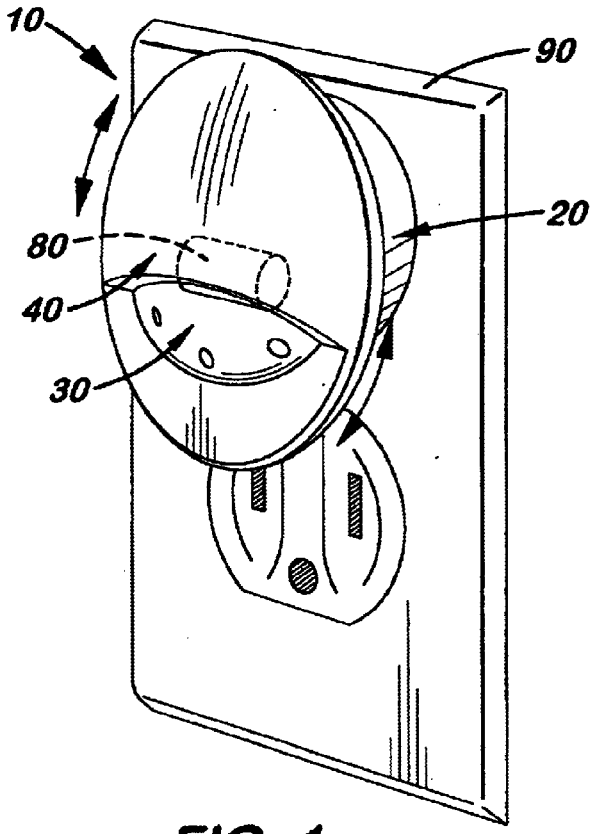
FIG. 1 is a respective view of a LED nightlight.

Referring to the accompanying FIGS. 1–7, there is shown an embodiment of a LED nightlight 10 comprised of a cylindrical base unit 20, a rotating outer cap 40 coupled to the base unit 20, and a fixed, half-spherical lens 30 disposed over the front surface 21 of the base unit 20 and inside the outer cap 40. The base unit 20 includes an inner cavity 24 in which a printed circuit board (PCB) 65 and a photo sensor 50 are located. Extending from the back surface 22 of the base unit 20 are two electrical prongs 60, 62. The photo sensor 50 and the two prongs 60, 62 are electrically connected to the PCB 65.

Figure 5:
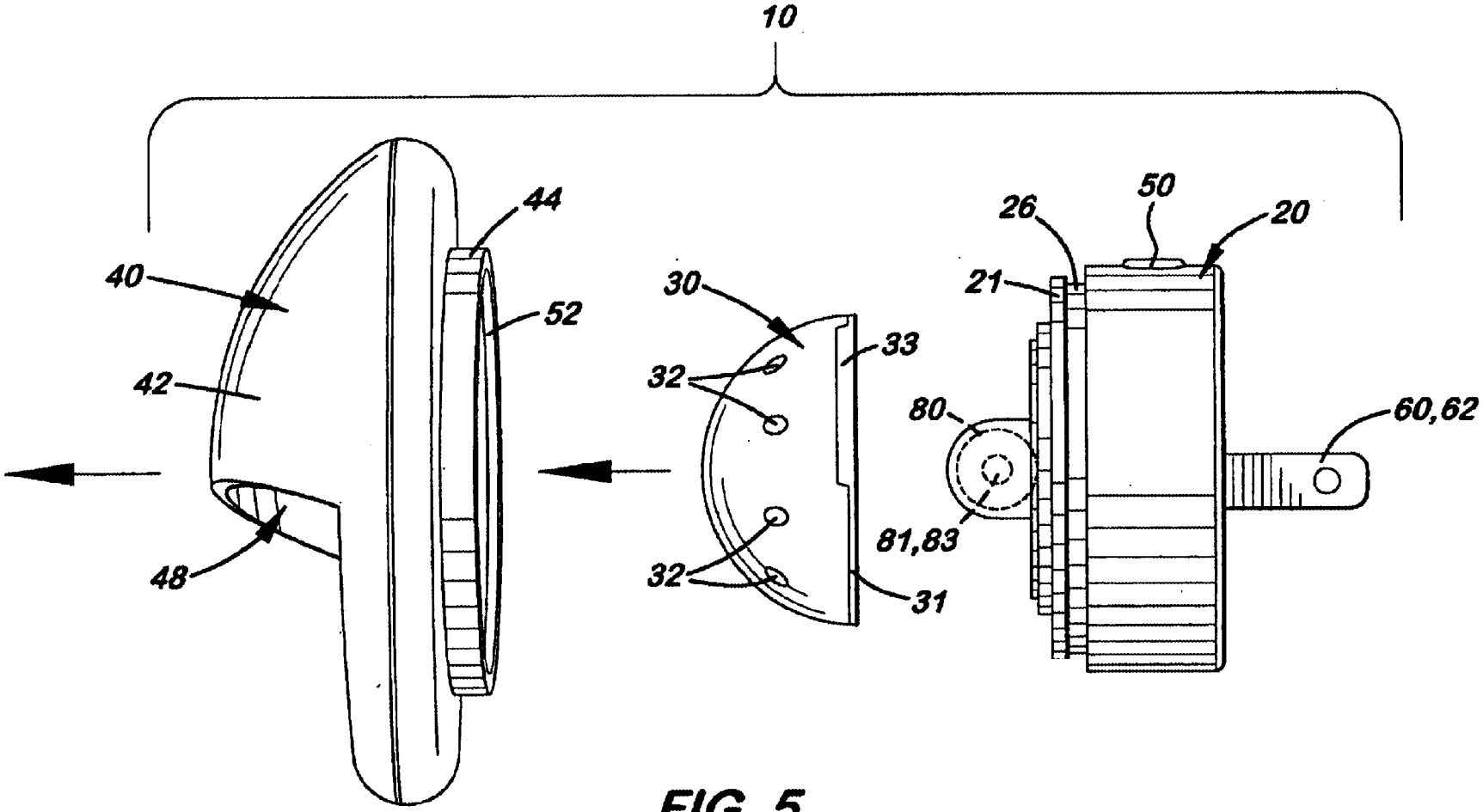
FIG. 5 is an exploded, side elevational view of the invention.
Figure 6:
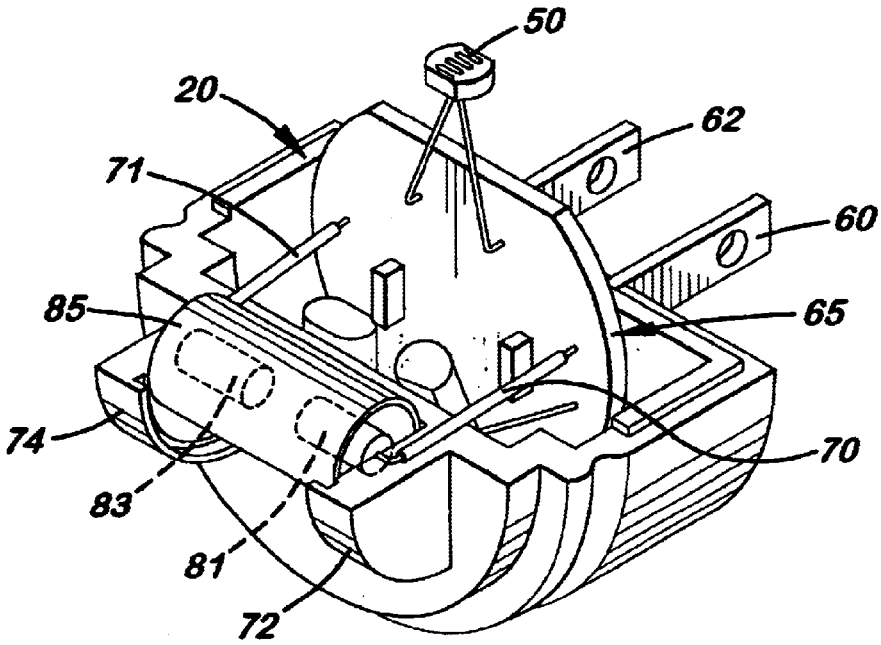
FIG. 6 is a perspective view of the invention with the top half of the base unit removed.
Figure 7:
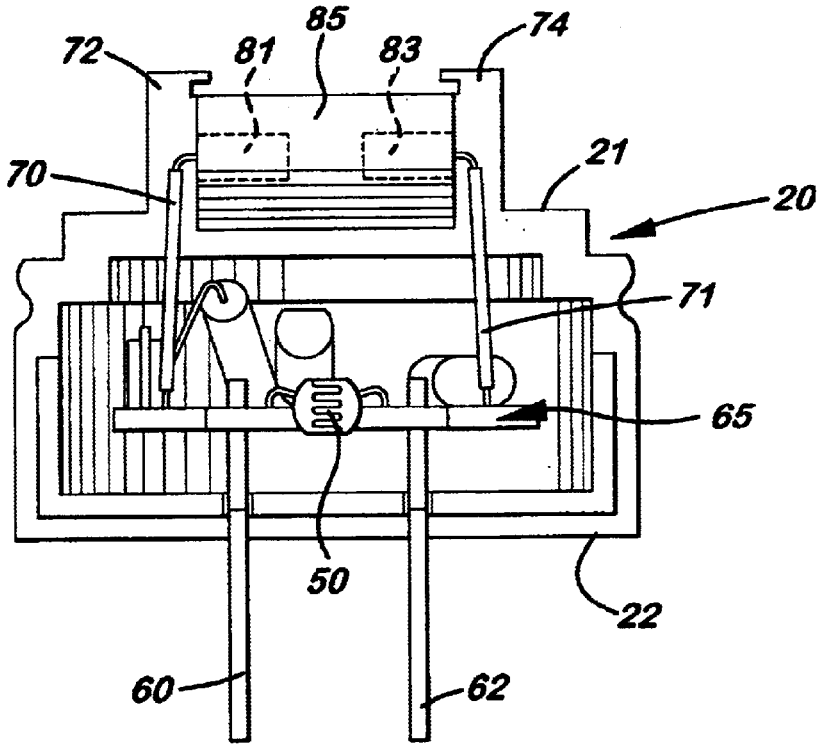
FIG. 7 a top plan view showing the invention shown in FIG. 6.

As shown more clearly in FIG. 5, the lens 30 is a half spherical-structure that is fixed in position over the front surface 21 of the base unit 20. Formed on the lens 30 is a plurality of optional vents 32 that enable heat from the LED tube 80 to escape from the lens 30 during use. The lens 30 includes a rear circular edge 31 with a keyed surface 33 formed thereon that engages a complementary-shaped recessed surface formed on the front surface 21 to lock the lens 30 in place over the front surface 21.

The rotating outer cap 40 includes a forward projecting half-spherical section 42 integrally attached to a cylindrical neck 44. Formed on the inside edge of the cylindrical neck 44 is an inward extending flange 52 which engages a complementary-shaped annular groove 26 formed on the outer surface of the base unit 20 adjacent to the front surface 21. During assembly, the flange 52 snap fits and engages the groove 26 to rotatably connect the outer cap 40 to the base unit 20. Formed on the body 42 is a quarter-spherical sized opening 48. During assembly, the outer cap 40 partially covers the lens 30 which holds the lens 30 on the base unit 20.

Mounted on the front surface 21 of the base unit 20 are two forward extending struts 72, 74. The struts 72, 74 are spaced apart and perpendicularly aligned on the front surface 21 of the base unit 20. In the preferred embodiments, the struts 72, 74 are longitudinally aligned with the electrical prongs 60, 62 so that the LED tube 80 is horizontally aligned over the front surface 21 when the prongs 60, 62 are plugged into a standard household electrical receptacle 90, as shown in FIG. 1. Mounted and extending inward on the inside surface of each strut 72, 74 is an LED bulb 81, 83, respectively. Extending between the two struts 72, 74 and covering each LED bulb 81, 83 is a cylindrical diffuser 85.

Figure 2:
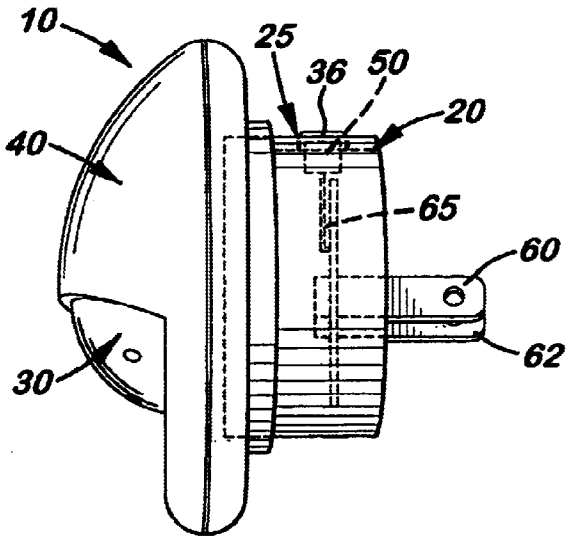
FIG. 2 is a side elevational view of the invention.
Figure 3:
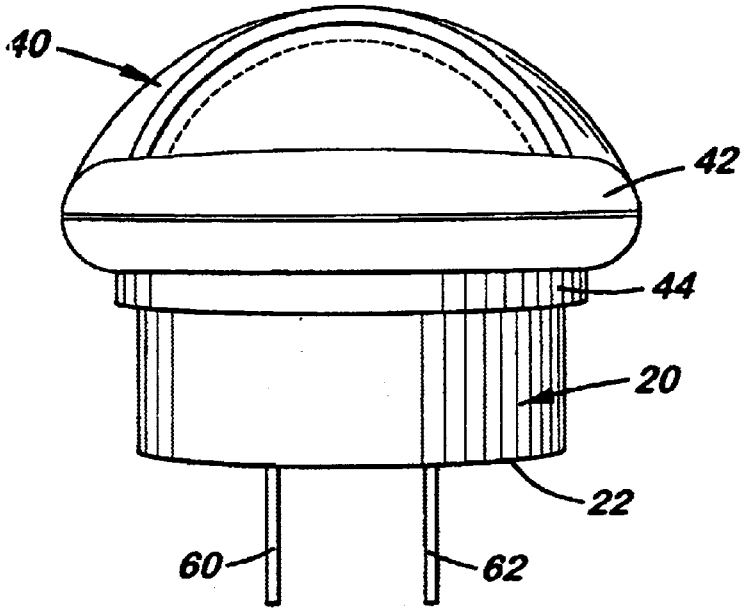
FIG. 3 is a bottom plan view of the invention.
Figure 4:
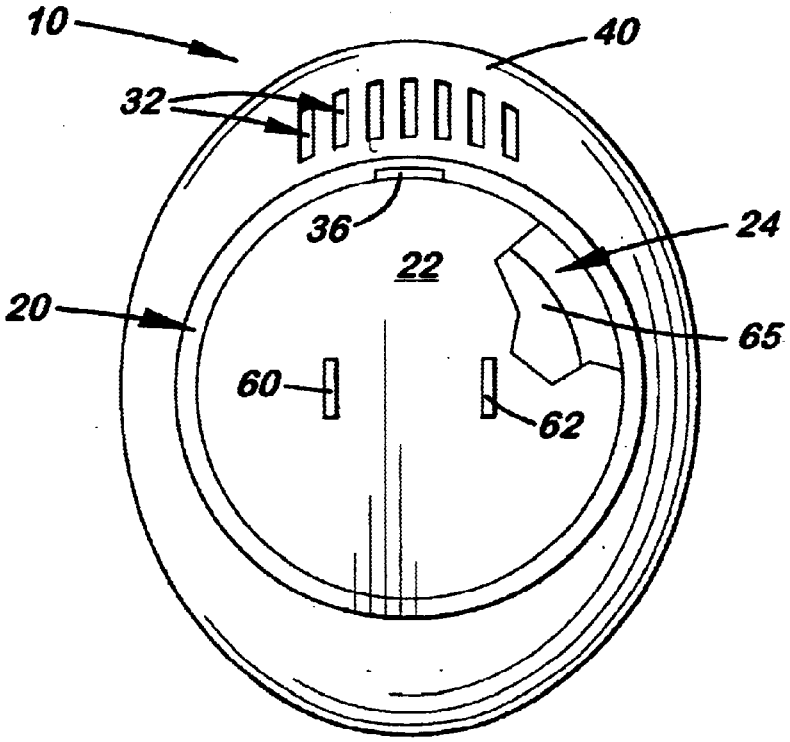
FIG. 4 is a rear elevational view of the invention.

Extending from the PCB 65 are contact plates 70, 71 that connect to the bulbs 81, 83, respectively. The two prongs 60, 62 extend through the back surface 22 of the base unit 20 and electrically connect to the PCB 65. A photo sensor 50 is connected to the PCB 65 and extends towards a small lens 36 that is disposed inside a small hole 25 formed on the lateral surface of the base unit 20, as shown in FIG. 2.

During use, the nightlight 10 is plugged into a standard electrical receptacle 90. The outer cap 40 may be selectively rotated 360 degrees, as shown in FIG. 1, over the base unit 20 so that light from the LED tube 80 is emitted in any desired direction. The quarter-spherical sized opening 48 allows light to be emitted through the closely fitting lens 30 approximately 180 degrees. As a result, a broad illuminated area adjacent to the nightlight 10, rather than a pinpoint of illumination, is produced.

In compliance with the statute, the invention described herein has been described in language more or less specific as to structural features. It should be understood, however, that the invention is not limited to the specific features shown since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A nightlight, comprising:

a. a base unit having a front surface, a rear surface, and at least two spaced-apart electric prongs mounted on said rear surface adapted to connect to an electric receptacle;

b. a printed circuit board located inside said base unit and connected to said electric prongs;

c. an LED tube mounted on said front surface of said base unit, said LED tube including at least two longitudinally aligned LED bulbs surrounded by a diffuser, said LED bulbs being connected to said printed circuit board;

d. an outer cover mounted on said front surface of said base unit and over said LED tube; and, e. a photo cell connected to said printed circuit board.

2. The nightlight, as recited in claim 1, further including two perpendicularly aligned struts mounted on said front surface of said base unit between which said LED tube is mounted.

3. The nightlight, as recited in claim 2, wherein said LED bulbs are mounted on said struts.

4. The nightlight, as recited in claim 3, wherein said diffuser is cylindrical and mounted between said struts.

5. The nightlight, as recited in claim 4, further including a half-spherical lens mounted on said front surface of said base unit and under said outer cover.

6. The nightlight, as recited in claim 2, further including a pair of contact plates that connect said LED bulbs to said printed circuit board.

7. The nightlight, as recited in claim 3, wherein said struts and prongs are longitudinally aligned.

8. A nightlight, comprising:

a. a base unit having a front surface, a rear surface, and at least two spaced-apart electric prongs mounted on said rear surface adapted to connect with an electric receptacle;

b. a printed circuit board located inside said base unit and connected to said electric prongs;

c. an LED tube mounted on said front surface of said base unit, said LED tube including at least two longitudinally aligned LED bulbs surrounded by a diffuser, said LED bulbs being connected to said printed circuit board capable of controlling said LED bulbs;

d. means for transversely mounting said LED tube on said front surface of said base unit;

e. an outer cover mounted on said base unit and over said LED tube;

f. a half-spherical lens mounted on said front surface of said base unit and under said outer cover; and, g. a photo cell connected to said printed circuit board.

9. The nightlight, as recited in claim 8, wherein said diffuser is cylindrical and longitudinally aligned between said LED bulbs.

10. The nightlight, as recited in claim 8, further including a pair of contact plates that connect said LED bulbs to said printed circuit board.

11. The nightlight, as recited in claim 8, wherein said struts and prongs are longitudinally aligned.

* * * * *